US008267075B2

(12) United States Patent
Kobayashi

(10) Patent No.: US 8,267,075 B2
(45) Date of Patent: Sep. 18, 2012

(54) IGNITION DEVICE FOR INTERNAL COMBUSTION ENGINE

(75) Inventor: Tatsuo Kobayashi, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 343 days.

(21) Appl. No.: 12/664,066

(22) PCT Filed: Jul. 17, 2008

(86) PCT No.: PCT/IB2008/001861
§ 371 (c)(1),
(2), (4) Date: Dec. 11, 2009

(87) PCT Pub. No.: WO2009/013584
PCT Pub. Date: Jan. 29, 2009

(65) Prior Publication Data

US 2010/0180873 A1 Jul. 22, 2010

(30) Foreign Application Priority Data

Jul. 24, 2007 (JP) ..... 2007-192094

(51) Int. Cl.
*F02P 15/00* (2006.01)
*H01T 13/08* (2006.01)

(52) U.S. Cl. ..... 123/647; 123/143 B; 123/169 EL; 313/143

(58) Field of Classification Search ..... 123/169 R, 123/169 EL, 169 E, 647, 143 B; 313/141–143
See application file for complete search history.

(56) References Cited

U.S. PATENT DOCUMENTS 3,738,331 A * 6/1973 Braun et al. ..... 123/210
3,871,349 A * 3/1975 Hager ..... 123/169 EL
4,493,297 A 1/1985 McIlwain et al.
(Continued)

FOREIGN PATENT DOCUMENTS

DE 297 20 529 1/1998
(Continued)

OTHER PUBLICATIONS

Jan. 10, 2012 Japanese Office Action (2007-192094 w/partial English translation).
(Continued)

*Primary Examiner* — Stephen K Cronin
*Assistant Examiner* — Arnold Castro
(74) *Attorney, Agent, or Firm* — Oblon, Spivak, McClelland, Maier & Neustadt, L.L.P.

(57) ABSTRACT

An ignition device includes: an axially extending chamber with an opening portion to be open to a cylinder and a bottom surface facing the opening portion; an outer electrode provided around the opening portion; and a center electrode that forms the bottom surface. When a voltage is applied between the center electrode and the outer electrode, a plasma is produced in the chamber and a plasma jet is injected through the opening portion. The ignition device includes: a metal housing formed integrally with or separately from the outer electrode; an insulating member that supports the center electrode while insulating the center electrode from the housing and the outer electrode; and a screw thread formed on a periphery of the housing by which the ignition device is screwed into a cylinder head of the internal combustion engine. A gasket is disposed in a side closer to the inside of the cylinder. A peripheral wall of the chamber is formed by the insulating member.

9 Claims, 3 Drawing Sheets

U.S. PATENT DOCUMENTS

| | | | | |
|---|---|---|---|---|
| 5,297,510 | A * | 3/1994 | Turkowski | 123/156 |
| 7,007,653 | B2 * | 3/2006 | Labarge et al. | 123/169 EL |
| 7,305,954 | B2 * | 12/2007 | Hagiwara et al. | 123/143 B |
| 7,328,677 | B2 * | 2/2008 | Hagiwara et al. | 123/143 B |
| 7,772,752 | B2 * | 8/2010 | Nakamura et al. | 313/141 |
| 7,827,954 | B2 * | 11/2010 | Nagasawa et al. | 123/143 B |
| 7,975,665 | B2 * | 7/2011 | Mori | 123/169 R |
| 8,082,897 | B2 * | 12/2011 | Kato et al. | 123/169 EL |
| 2006/0137642 | A1 * | 6/2006 | Artmann et al. | 123/169 EL |
| 2007/0114898 | A1 * | 5/2007 | Nagasawa et al. | 313/141 |
| 2007/0221156 | A1 * | 9/2007 | Hagiwara et al. | 123/143 B |
| 2007/0221157 | A1 * | 9/2007 | Hagiwara et al. | 123/143 B |
| 2008/0238281 | A1 * | 10/2008 | Nakamura et al. | 313/141 |

FOREIGN PATENT DOCUMENTS

| | | |
|---|---|---|
| EP | 0 969 575 | 1/2000 |
| JP | 54-28945 | 3/1979 |
| JP | 56-35793 | 8/1979 |
| JP | 55-111086 | 8/1980 |
| JP | 56-102089 | 8/1981 |
| JP | 57-15378 | 1/1982 |
| JP | 58-150285 | 9/1983 |
| JP | 59-173991 | 11/1984 |
| JP | 60-891 | 1/1985 |
| JP | 62-145678 | 6/1987 |
| JP | 2006 294257 | 10/2006 |
| WO | 2005 005819 | 1/2005 |

OTHER PUBLICATIONS

Jul. 19, 2011 Japanese Office Action (2007-192094 w/partial English translation).

* cited by examiner

IGNITION DEVICE FOR INTERNAL COMBUSTION ENGINE

BACKGROUND OF THE INVENTION

1. Field of the Invention

The invention relates to an ignition device for an internal combustion engine.

2. Description of the Related Art

In an internal combustion engine, it is necessary to unfailingly ignite homogeneous air-fuel mixture in the entire space in a cylinder or air-fuel mixture in a part of the cylinder using a spark plug. However, a conventional spark plug, which generates a spark in a spark gap, ignites the air-fuel mixture only at one point, and thus, the conventional spark plug has relatively low ignitability.

An ignition device that employs the plasma jet injection has been proposed for improving the ignitability (for example, refer to Japanese Patent Application Publication No. 2006-294257 (JP-A-2006-294257)). The ignition device includes a chamber, an outer electrode, and a center electrode. The chamber is provided with an opening portion to be open to the cylinder and a bottom surface that is disposed facing the opening portion, the chamber extending in the axial direction. The outer electrode is disposed around the opening portion, and the center electrode is disposed to provide the bottom surface in the chamber. The plasma is produced in the chamber by applying voltage between the center electrode and the outer electrode. In the thus-configured ignition device, the plasma jet is injected through the opening portion of the chamber so that the part of the air-fuel mixture over a predetermined area that corresponds to a sectional area of the injected plasma jet is simultaneously ignited. Therefore, the ignition device improves the ignitability.

The ignition device described in Japanese Patent Application Publication No. 2006-294257 (JP-A-2006-294257) includes a metal housing that is formed integrally with or separately from the outer electrode. The center electrode is supported by an insulating member, insulated from the housing and the outer electrode, and the insulating member forms a peripheral wall of the chamber. A screw thread is formed on a periphery of the housing so that the ignition device is screwed into a cylinder head, and a gasket is disposed in an outer side than the screw thread. Therefore, a relatively long portion of the ignition device, including the screw thread, that is positioned in a side closer to the inside of the cylinder than the gasket is exposed to the high-temperature combusted gas in the cylinder, which results in an insufficient heat dissipation from the insulating member. Therefore, in order to ensure the heat resistance of the ignition device, the thickness of the insulating member that forms the peripheral wall of the chamber needs to be relatively thick.

SUMMARY OF THE INVENTION

The invention provides an ignition device for an internal combustion engine that includes: a chamber with an opening portion to be open to a cylinder and a bottom surface that is disposed facing the opening portion, the chamber extending in an axial direction; an outer electrode provided around the opening portion; and a center electrode that forms the bottom surface in the chamber, wherein when a voltage is applied between the center electrode and the outer electrode, a plasma is produced in the chamber and a plasma jet is injected through the opening portion into the cylinder, wherein a thickness of an insulating member, which forms a peripheral wall of a chamber between the outer electrode and the center electrode, is reduced, compared to the thickness of the insulating member of the ignition device according to the related art.

An aspect of the invention relates to an ignition device for an internal combustion engine that includes: a chamber with an opening portion to be open to a cylinder of the internal combustion engine and a bottom surface that is disposed facing the opening portion, the chamber extending in an axial direction; an outer electrode provided around the opening portion; and a center electrode that forms the bottom surface in the chamber, wherein when a voltage is applied between the center electrode and the outer electrode, a plasma is produced in the chamber and a plasma jet is injected through the opening portion into the cylinder. The ignition device includes: a housing that accommodates the center electrode, is made of a metal, and is formed integrally with or separately from the outer electrode; an insulating member that supports the center electrode while insulating the center electrode from the housing and the outer electrode; and a screw thread by which the ignition device is screwed into a cylinder head of the internal combustion engine, the screw thread being formed on a periphery of the housing. In the ignition device, a gasket for keeping the cylinder airtight is disposed in a side closer to the inside of the cylinder than the screw thread, and a peripheral wall of the chamber is formed by the insulating member.

According to the aforementioned aspect, the ignition device includes the metal housing that is formed integrally with or separately from the outer electrode, and the center electrode is supported by the insulating member, insulated from the housing and the outer electrode. The insulating member forms the peripheral wall of the chamber, and the screw thread is formed on the periphery of the housing so that the ignition device is screwed into the cylinder head. The gasket that keeps the cylinder airtight is disposed in the side closer to the inside of the cylinder than the screw thread. With this configuration, the screw thread is disposed in the outer side than the gasket that provides a seal against the high-temperature combusted gas in the cylinder. Therefore, the screw thread is not included in a portion exposed to the high-temperature combusted gas in the cylinder, and thus it is possible to reduce the axial length of the portion of the ignition device exposed to the high-temperature combusted gas. Accordingly, heat is sufficiently dissipated from the insulating member, whereby it is possible to make a radial thickness of the insulating member of the peripheral wall of the chamber, which is given to ensure heat resistance, relatively thin.

In this way, if the radial thickness of the insulating member of the peripheral wall of the chamber is reduced, it is possible to make the ignition device more compact, and the housing, which functions as a grounding electrode, brings about the backside electrode effect (i.e. the effect by which the creeping discharge easily occurs along a surface of the peripheral wall of the chamber). Therefore, it is possible to cause the creeping discharge to occur along the inner peripheral surface of the insulating member even by applying lower voltage at the early stages of generation of the plasma by the arc discharge in a central area in the chamber, and it is also possible to reduce the required voltage for initial operation of the ignition device.

In the aforementioned aspect, a radial thickness of a portion of the insulating member that forms the peripheral wall of the chamber may be in a range of 0.5 mm to 1.0 mm.

According to the configuration described above, the radial thickness of the portion of the insulating member that forms the peripheral wall of the chamber is designed to be in the range of 0.5 mm to 1.0 mm, whereby it is possible to achieve the desired backside electrode effect as descried above.

In the configuration described above, at least one of the center electrode and the outer electrode may be provided with a projection portion near a peripheral wall of the chamber.

According to the configuration described above, the electric field is concentrated at the projection portion provided on the center electrode or the outer electrode, which makes it possible to cause the creeping discharge to occur along the inner peripheral surface of the insulating member even by applying lower voltage, whereby it is possible to further reduce the required voltage for initial operation of the ignition device.

In the configuration described above, at least one of the center electrode and the outer electrode may be provided with a minimum distance path forming means in a portion corresponding to a center portion of the chamber.

According to the configuration described above, immediately after the occurrence of the creeping discharge, the arc discharge occurs in the central area in the chamber by the minimum distance path forming means between the center electrode and the outer electrode. Therefore, the electric discharge from the projection portion does not last for a long time, whereby it is possible to preserve the projection portion.

In the configuration described above, an intermediate electrode may be provided on the peripheral wall of the chamber between the center electrode and the outer electrode.

According to the configuration described above, when the voltage is applied between the center electrode and the outer electrode, due to the creeping discharge along a short path from the center electrode to the intermediate electrode, an electric potential at the intermediate electrode is easily made substantially equal to the applied voltage. Further, the creeping discharge is easily caused to occur along a short path from the intermediate electrode to the outer electrode. Thus, even when the set value of the required voltage for initial operation of the ignition device is reduced, it is still possible to cause the creeping discharge to occur between the center electrode and the outer electrode, and to cause the arc discharge to occur in the central area in the chamber.

In the configuration described above, the intermediate electrode may include an extending portion that extends toward the housing.

According to the configuration described above, the intermediate electrode is provided further closer to the grounding electrode, which is the housing. Therefore, even when the voltage applied between the center electrode and the outer electrode is further reduced, the creeping discharge occurs between the center electrode and the intermediate electrode and then occurs between the intermediate electrode and the outer electrode. Therefore, it is possible to cause the arc discharge to occur in the central area in the chamber.

In the configuration described above, a gas inlet groove may be provided in a periphery of the opening portion in a manner such that the gas inlet groove extends through in a tangential direction.

According to the configuration described above, when gas in the cylinder flows into the chamber, a spiral flow of the gas that is directed in the axial direction is produced in the chamber. Accordingly, the arc discharge is more frequently brought into contact with the gas in the chamber, and thus it is possible to make it easier to turn the gas in the chamber into a plasma.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF THE PREFERRED EMBODIMENTS

Figure 1:
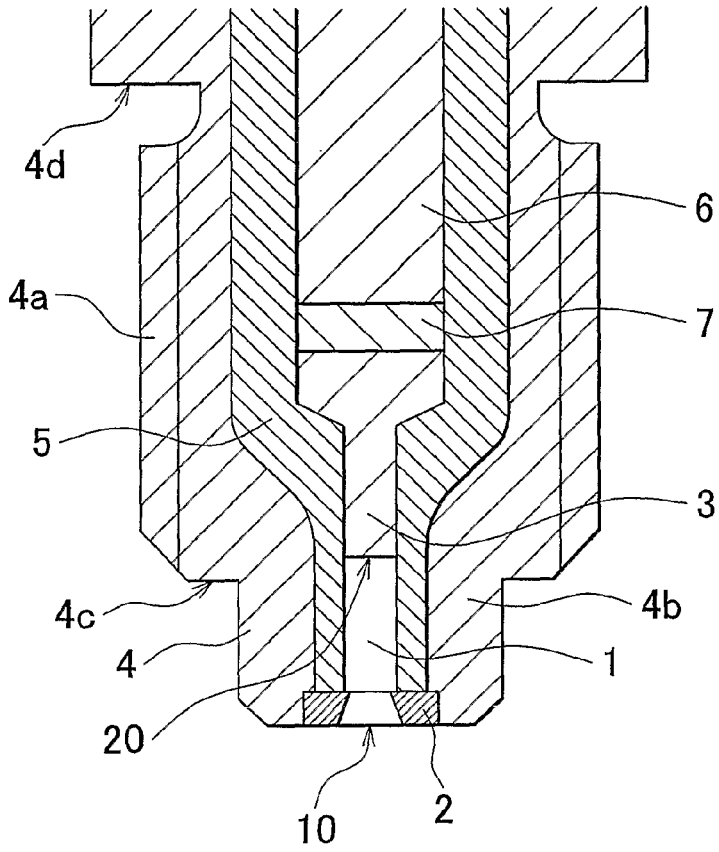
FIG. 1 is a sectional view showing a tip portion of an ignition device for an internal combustion engine according to an embodiment of the invention.

FIG. 1 is a sectional view showing a tip portion of an ignition device for an internal combustion engine according to an embodiment of the invention. As shown in FIG. 1, the ignition device for an internal combustion engine according to the embodiment includes a chamber 1 that is provided with an opening portion 10 to be open to a cylinder and a bottom surface 20 that is disposed facing the opening portion 10. The chamber 1 extends along an axial direction of the ignition device, and plasma is produced in the chamber 1. An outer electrode 2 is provided around the opening portion 10, and a center electrode 3 is disposed to provide the bottom surface 20 in the chamber 1.

The outer electrode 2 and the center electrode 3 may be made of heat-resistant and highly electrically-conductive metal, which is, for example, iron-based metal such as stainless steel, nickel-based metal, or iridium-based metal. According to the embodiment, the outer electrode 2 is formed separately from a metal housing 4. However, the outer electrode 2 may be formed integrally with the housing 4. The center electrode 3 is supported by an insulating member 5, insulated from the housing 4 and the outer electrode 2. The insulating member 5 may be made of ceramics (for example, alumina ceramics). In this way, the insulating member 5 forms a peripheral wall, extending in the axial direction, of the chamber 1.

A screw thread portion 4*a* is foamed on a periphery of the housing 4 so that the ignition device is screwed into a cylinder head (not shown). The housing 4 includes a small diameter portion 4*b* that is disposed in a portion closer to the tip portion of the housing 4 than the screw thread portion 4*a*. A shoulder portion 4*c*, which is the boundary between the small diameter portion 4*b* and the other portion of the housing 4, provides a surface with which a gasket (not shown) for keeping the cylinder airtight is brought into contact. If an O-ring is used as the gasket, an O-ring groove may be formed in a portion of the cylinder head that corresponds in position to the shoulder portion 4*c*, or may be formed in the shoulder portion 4*c*. The gasket, which is used for keeping the cylinder airtight, is disposed in a side closer to the inside of the cylinder than the screw thread portion 4*a*. Further, the ignition device includes a conductor 6 (for example, nickel) for applying voltage to the center electrode 3, and the conductor 6 and the center electrode 3 are electrically connected to each other by an electrically conductive adhesive 7.

In the thus-configured ignition device according to the embodiment, when voltage is applied between the center electrode 3 and the outer electrode 2, creeping discharge occurs along an inner peripheral surface of the insulating member 5 between the center electrode 3 and the outer electrode 2. When the creeping discharge occurs, the arc discharge subsequently occurs in a center portion of the chamber 1 between the center electrode 3 and the outer electrode 2. Due to the occurrence of the arc discharge, gas in the chamber 1 is turned into a plasma, and the gas in the chamber 1 is thermally expanded. In this way, the plasma jet containing electrons and positive ions is injected through the opening portion 10 of the chamber 1 into the cylinder. Because the plasma jet is injected in a form that has a certain sectional area, it is possible to simultaneously ignite and combust a relatively large part of homogeneous air-fuel mixture in the entire space in the cylinder or the combustible air-fuel mixture in a part of the space in the cylinder. Therefore, the plasma jet injection is very advantageous in terms of ignitability.

Figure 2:
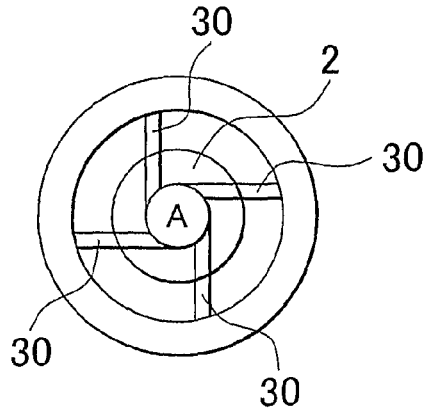
FIG. 2 is a front view showing the tip portion of the ignition device shown in FIG. 1.

FIG. 2 is a front view showing the tip portion of the ignition device according to the embodiment. Gas inlet grooves 30 are formed in the tip surface of the ignition device around the opening portion 10, each gas inlet groove extending through in a tangential direction. In this embodiment, the four gas inlet grooves 30 are formed at regular intervals. However, the number of the gas inlet groove(s) 30 may be at least one. With this configuration, when gas in the cylinder flows into the chamber 1 through the gas inlet grooves 30, a spiral flow of the gas that is directed in the axial direction is produced in the chamber 1. Accordingly, the arc discharge is more frequently brought into contact with the gas in the chamber, and thus it is possible to make it easier to turn the gas in the chamber into a plasma.

In the embodiment, the gasket for keeping the cylinder airtight is disposed in the side closer to the inside of the cylinder than the screw thread portion 4*a*. With this configuration, the screw thread portion 4*a* provided on the periphery of the housing 4 is disposed in an outer side than the gasket that seals the high-temperature combusted gas in the cylinder. Therefore, the screw thread portion 4*a* is not included in an inner portion exposed to the high-temperature combusted gas in the cylinder, and thus it is possible to reduce the axial length of the portion of the ignition device exposed to the high-temperature combusted gas. Accordingly, heat is sufficiently dissipated from the insulating member 5 through the housing 4, whereby it is possible to make a radial thickness of the insulating member 5, which is given to ensure heat resistance, for forming the chamber 1, relatively thin, for example, in the range of 0.5 mm to 1.0 mm.

In a conventional ignition device, the gasket is disposed in a shoulder portion 4*d* located in the outer side than the screw thread portion 4*a*. Thus, the screw thread portion 4*a* is included in the portion exposed to the high-temperature combusted gas in the cylinder, and the axial length of the portion exposed to the high-temperature combusted gas is relatively long. Therefore, heat is not sufficiently dissipated from the insulating member 5, and thus, it is necessary to make the radial thickness of the insulating member 5 relatively thick in order to ensure heat resistance.

In this way, according to the embodiment, if the radial thickness of the insulating member 5 that defines the chamber 1 is reduced, it is possible to make the ignition device more compact, and the housing 4, which functions as a grounding electrode, brings about the backside electrode effect. Therefore, it is possible to cause the creeping discharge to occur along the inner peripheral surface of the insulating member 5 even by applying lower voltage and it is also possible to reduce the required voltage for initial operation of the ignition device at the early stages of generation of the plasma by the arc discharge in a central area in the chamber.

Figure 3:
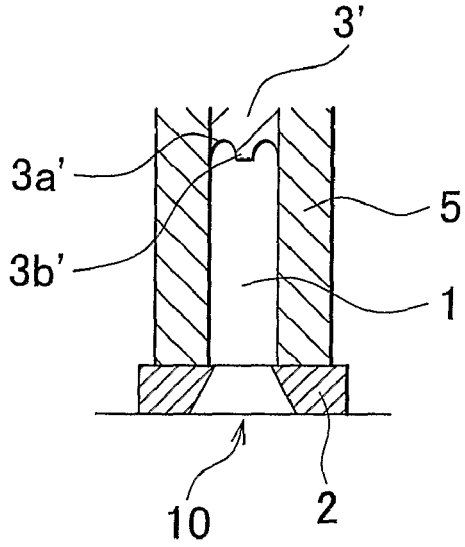
FIG. 3 shows a modification example of a center electrode.

FIG. 3 shows a modification example of the center electrode. A center electrode 3' of the ignition device according to this modification example includes a projection portion 3*a*' near the peripheral wall of the chamber 1. A plurality of projection portions 3*a*' may be provided on the center electrode 3' at the entire periphery thereof near the peripheral wall of the chamber 1. If the projection portion 3*a*' is provided as described above, the electric field is concentrated at the projection portion 3*a*', which makes it possible to cause the creeping discharge to occur along the inner peripheral surface of the insulating member 5 even by applying lower voltage, so that it is possible to further reduce the required voltage for initial operation of the ignition device. Further, a center portion 3*b*' of the center electrode 3' projects toward the outer electrode 2, so that a minimum distance path is formed between the outer electrode 2 and the center portion 3*b*'. With this configuration, immediately after the occurrence of the creeping discharge, the arc discharge occurs in a central area in the chamber 1 along the minimum distance path, and the gas in the chamber 1 is turned into a plasma by the arc discharge. With the center portion 3*b*' provided as described above, the electric discharge from the projection portion 3*a*' of the center electrode 3' does not last for a long time, and therefore, it is possible to preserve the projection portion 3*a*'.

Figure 4:
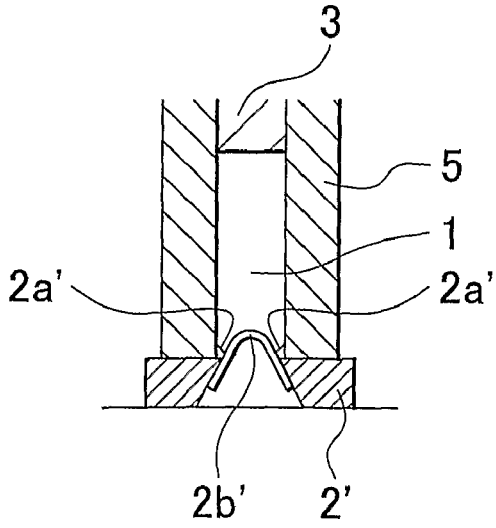
FIG. 4 shows a modification example of an outer electrode.

FIG. 4 shows a modification example of the outer electrode. An outer electrode 2' of the ignition device according to this modification example includes a projection portion 2*a*' near the peripheral wall of the chamber 1. A plurality of projection portions 2*a*' may be provided on the outer electrode 2' at the entire periphery thereof near the peripheral wall of the chamber 1. If the projection portion 2*a*' is provided as described above, the electric field is concentrated at the projection portion 2*a*', which makes it possible to cause the creeping discharge to occur along the inner peripheral surface of the insulating member 5 even by applying lower voltage, so that it is possible to further reduce the required voltage for initial operation of the ignition device. Further, a center portion of the outer electrode 2' projects toward the center electrode 3 by providing a U-shaped wire member 2*b*' so that a minimum distance path is formed between the center portion of the outer electrode 2' and the center electrode 3. With this configuration, immediately after the occurrence of the creeping discharge, the arc discharge occurs in the central area in the chamber 1 along the minimum distance path, and the gas in the chamber 1 is turned into a plasma by the arc discharge. In this way, the electric discharge from the projection portion 2*a*' of the outer electrode 2' does not last for a long time, and therefore, it is possible to preserve the projection portion 2*a*'.

Figure 5:
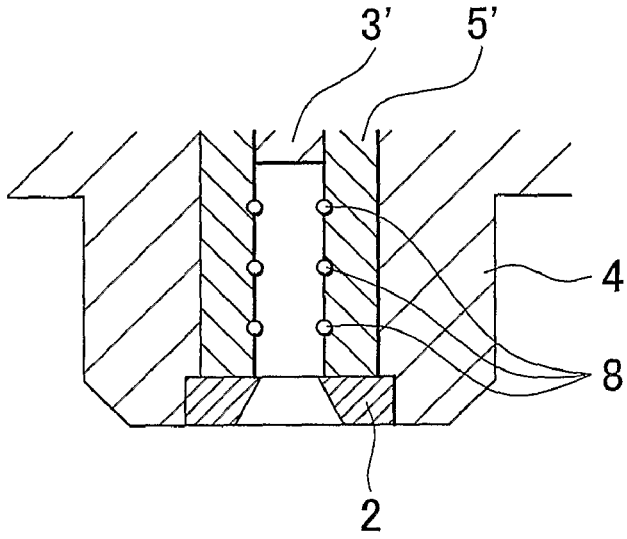
FIG. 5 shows a modification example of an insulating member.

FIG. 5 shows a modification example of the insulating member that forms the peripheral wall of the chamber 1. Intermediate electrodes 8 are provided between the center electrode 3 and the outer electrode 2 on the inner peripheral surface of an insulating member 5' of the ignition device according to this modification example. In the modification example, the three intermediate electrodes 8 are provided at regular intervals in terms of the creepage distance from the center electrode 3 to the outer electrode 2. However, the number of the intermediate electrode(s) 8 may be at least one. Each of the intermediate electrodes 8 is C-ring shaped, and fitted into a groove formed in the inner peripheral surface of the insulating member 5'.

In the configuration described above, when voltage is applied between the center electrode 3 and the outer electrode 2, due to the creeping discharge along a short path from the center electrode 3 to one of the intermediate electrodes 8 that is disposed closest to the center electrode 3 (hereinafter referred to as "first intermediate electrode 8"), the electric potential of the first intermediate electrode 8 is easily made substantially equal to the applied voltage. Then, the creeping discharge along a short path from the first intermediate electrode 8 to one of the intermediate electrodes that is disposed in the middle (hereinafter referred to as "second intermediate electrode 8") easily occurs, whereby the electric potential of the second intermediate electrode 8 is made substantially equal to the applied voltage. Further, the creeping discharge along a short path from the second intermediate electrode 8 to the one of the intermediate electrodes 8 that is disposed closest to the outer electrode 2 (hereinafter referred to as "third intermediate electrode 8") easily occurs, whereby the electric potential of the third intermediate electrode 8 is made substantially equal to the applied voltage. Further, the creeping discharge along a short path from the third intermediate electrode 8 to the outer electrode 2 is easily caused to occur. Thus, even when the set value of the required voltage for initial operation of the ignition device is reduced, it is still possible to cause the creeping discharge to occur between the center electrode 3 and the outer electrode 2, and to cause the arc discharge to occur in the central area in the chamber 1.

Figure 6:
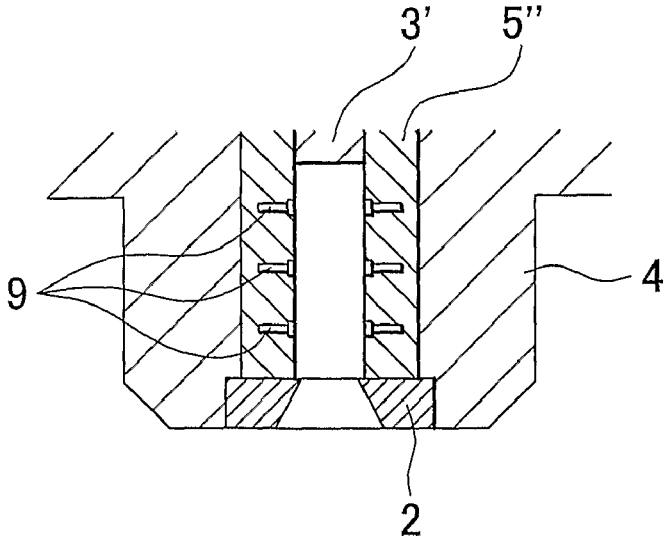
FIG. 6 shows another modification example of the insulating member.

FIG. 6 shows another modification example of the insulating member that forms the peripheral wall of the chamber 1. Intermediate electrodes 9 are provided between the center electrode 3 and the outer electrode 2 on an inner peripheral surface of an insulating member 5" of the ignition device according to this modification example. In this modification example, the three intermediate electrodes 9 are provided at regular intervals in terms of the creepage distance from the center electrode 3 to the outer electrode 2. However, the number of the intermediate electrode(s) 9 may be at least one. Each of the intermediate electrodes 9 includes an extending portion that extends toward the housing 4, and is formed by casting when the insulating member 5" is formed by injection molding.

In the configuration as described above, the intermediate electrodes 9 are provided further closer to the grounding electrode, which is the housing 4. Therefore, even when the voltage applied between the center electrode 3 and the outer electrode 2 is further reduced, the creeping discharge sequentially occurs between the center electrode 3 and one of the intermediate electrodes 9 that is disposed closest to the center electrode 3, between the two adjacent intermediate electrodes 9, and between the outer electrode 2 and one of the intermediate electrodes 9 that is disposed closest to the outer electrode 2. Therefore, it is possible to cause the arc discharge to occur in the central area in the chamber 1. In this modification example, the extending portion of the intermediate electrode 9 by which the intermediate electrode 9 is disposed closer to the grounding electrode (housing 4) may be configured in any appropriate shape, such as an L-shape.

The invention claimed is:

1. An ignition device for an internal combustion engine comprising:

a chamber with an opening portion to be open to a cylinder of the internal combustion engine and a bottom surface that is disposed facing the opening portion, the chamber extending in an axial direction of the ignition device;

an outer electrode provided around the opening portion;

a center electrode that forms the bottom surface of the chamber, wherein when a voltage is applied between the center electrode and the outer electrode, a plasma is produced in the chamber and a plasma jet is injected through the opening portion into the cylinder;

a housing that accommodates the center electrode, that is made of a metal, and that is formed integrally with or separately from the outer electrode;

an insulating member that supports the center electrode while insulating the center electrode from the housing and the outer electrode; and a screw thread by which the ignition device is screwed into a cylinder head of the internal combustion engine, the screw thread being formed on a periphery of the housing, wherein:

the housing includes a small diameter portion, the small diameter portion being disposed in a portion closer to the opening portion of the housing than the screw thread and being disposed closer to the opening portion than the bottom surface of the chamber formed by the center electrode relative to a longitudinal direction of the ignition device;

a gasket for keeping the cylinder airtight is disposed at a boundary between the small diameter portion and the other portion of the housing; and a peripheral wall of the chamber is formed by the insulating member.

2. The ignition device according to claim 1, wherein a radial thickness of the insulating member that forms the peripheral wall of the chamber is in a range of 0.5 mm to 1.0 mm.

3. The ignition device according to claim 1, wherein at least one of the center electrode and the outer electrode includes a projection portion near a peripheral wall of the chamber.

4. The ignition device according to claim 1, wherein at least one of the center electrode and the outer electrode includes a minimum distance path forming portion in a portion corresponding to a center portion of the chamber.

5. The ignition device according to claim 4, wherein the minimum distance path forming portion is a projection portion that is provided in a center portion of the center electrode and projects toward the opening portion.

6. The ignition device according to claim 4, wherein the minimum distance path forming portion is a U-shaped wire member that is provided in a center portion of the outer electrode and projects toward the center electrode.

7. The ignition device according to claim 1, wherein an intermediate electrode is provided on the peripheral wall of the chamber between the center electrode and the outer electrode.

8. The ignition device according to claim 7, wherein the intermediate electrode includes an extending portion that extends toward the housing in a radial outward direction of the chamber.

9. The ignition device according to claim 1, wherein:

the chamber is formed in a substantially cylindrical shape; and a gas inlet groove is provided in a periphery of the opening portion such that the gas inlet groove extends through in a tangential direction of the chamber.

* * * * *